US006499945B1

(12) United States Patent
Lathrop

(10) Patent No.: US 6,499,945 B1
(45) Date of Patent: Dec. 31, 2002

(54) WHEELSPACE WINDAGE COVER PLATE FOR TURBINE

(75) Inventor: Norman Douglas Lathrop, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/576,066

(22) Filed: May 22, 2000

Related U.S. Application Data

(63) Continuation of application No. 09/226,462, filed on Jan. 6, 1999, now abandoned.

(51) Int. Cl.[7] ..... F01D 9/00
(52) U.S. Cl. ..... 415/198 A; 416/220 R
(58) Field of Search ..... 415/198 A, 230; 416/220 R, 248, 191, 189

(56) References Cited

U.S. PATENT DOCUMENTS

| | | | | |
|---|---|---|---|---|
| 3,807,898 A | | 4/1974 | Guy et al. | |
| 4,645,424 A | | 2/1987 | Peters | |
| 5,211,407 A | | 5/1993 | Glynn et al. | |
| 5,256,035 A | * | 10/1993 | Norris et al. | 416/220 R |
| 5,318,405 A | | 6/1994 | Meade et al. | |
| 5,445,499 A | | 8/1995 | Charbonnel | |
| 6,019,580 A | * | 2/2000 | Barr et al. | 416/219 R |

OTHER PUBLICATIONS

"39$^{th}$ Turbine State–of–the–Art Technology Seminar", Tab 1, ""F" Technology –the First Half–Million Operating Hours", H.E. Miller, Aug. 1996.
"39$^{th}$ Turbine State–of–the–Art Technology Seminar", Tab 2, "GE Heavy–Duty Gas Turbine Performance Characteristics", F. J. Brooks, Aug. 1996.
"39$^{th}$ Turbine State–of–the–Art Technology Seminar", Tab 3, "EC 50Hz 170–MW Class Gas Turbine", A. S. Arrao, Aug. 1996.
"39$^{th}$ Turbine State–of–the–Art Technology Seminar", Tab 4, "MWS6001FA –An Advanced–Technology 70–MW Class 50/60 Hz Gas Turbine", Ramachandran et al., Aug. 1996.
"39$^{th}$ Turbine State–of–the–Art Technology Seminar", Tab 5, "Turbomachinery Technology Advances at Nuovo Pignone", Benvenuti et al., Aug. 1996.
"39$^{th}$ Turbine State–of–the–Art Technology Seminar", Tab 6, "GE Aeroderivative Gas Turbines –Design and Operating Features", M.W. Horner, Aug. 1996.
"39$^{th}$ Turbine State–of–the–Art Technology Seminar", Tab 7, "Advance Gas Turbine Materials and Coatings", P.W. Schilke, Aug. 1996.
"39$^{th}$ Turbine State–of–the–Art Technology Seminar", Tab 8, "Dry Low $NO_x$ Combustion Systems for GE Heavy–Duty Turbines", L.B. Davis, Aug. 1996.
"39$^{th}$ Turbine State–of–the–Art Technology Seminar", Tab 9, "GE Gas Turbine Combustion Flexibility", M.A. Davi, Aug. 1996.
"39$^{th}$ Turbine State–of–the–Art Technology Seminar", Tab 10, "Gas Fuel Clean–Up System Design Considerations for GE Heavy–Duty Gas Turbines", C. Wilkes, Aug. 1996.
"39$^{th}$ Turbine State–of–the–Art Technology Seminar", Tab 11, "Integrated Control Systems for Advanced Combined Cycles", Chu et al., Aug. 1996.

(List continued on next page.)

*Primary Examiner*—Edward K. Look
*Assistant Examiner*—James M McAleenan
(74) *Attorney, Agent, or Firm*—Nixon & Vanderhye

(57) ABSTRACT

Windage cover plates are secured between the wheels and spacer of a turbine rotor to prevent hot flow path gas ingestion into the wheelspace cavities. Each cover plate includes a linear, axially extending body curved circumferentially with a radially outwardly directed wall at one axial end. The wall defines a axially opening recess for receiving a dovetail lug. The cover plate includes an axially extending tongue received in a circumferential groove of the spacer. The cover plate is secured with the tongue in the groove and dovetail lug in the recess. Lap joints between circumferentially adjacent cover plates are provided.

12 Claims, 7 Drawing Sheets

OTHER PUBLICATIONS

"39th Turbine State–of–the–Art Technology Seminar", Tab 12, "Power Systems for the 21st Century "H" Gas Turbine Combined Cycles", Paul et al., Aug. 1996.
"39th Turbine State–of–the–Art Technology Seminar", Tab 13, "Clean Coal and Heavy Oil Technologies for Gas Turbines", D. M. Todd, Aug. 1996.
"39th Turbine State–of–the–Art Technology Seminar", Tab 14, "Gas Turbine Conversions, Modifications and Uprates Technology", Stuck et al., Aug. 1996.
"39th Turbine State–of–the–Art Technology Seminar", Tab 15, "Performance and Reliability Improvements for Heavy–Duty Gas Turbines, " J. R. Johnston, Aug. 1996.
"39th Turbine State–of–the–Art Technology Seminar", Tab 16, "Gas Turbine Repair Technology", Crimi et al, Aug. 1996.
"39th Turbine State–of–the–Art Technology Seminar", Tab 17, "Heavy Duty Turbine Operating & Maintenance Considerations", R. F. Hoeft, Aug. 1996.
"39th Turbine State–of–the–Art Technology Seminar", Tab 18, "Gas Turbine Performance Monitoring and Testing", Schmitt et al., Aug. 1996.
"39th Turbine State–of–the–Art Technology Seminar", Tab 19, "Monitoring Service Delivery System and Diagnostics", Madej et al., Aug. 1996.
"39th Turbine State–of–the–Art Technology Seminar", Tab 20, "Steam Turbines for Large Power Applications", Reinker et al., Aug. 1996.
"39th Turbine State–of–the–Art Technology Seminar", Tab 21, "Steam Turbines for Ultrasupercritical Power Plants", Retzlaff et al., Aug. 1996.
"39th Turbine State–of–the–Art Technology Seminar", Tab 22, "Steam Turbine Sustained Efficiency", P. Schofield, Aug. 1996.
"39th Turbine State–of–the–Art Technology Seminar", Tab 23, "Recent Advances in Steam Turbines for Industrial and Cogeneration Applications", Leger et al., Aug. 1996.
"39th Turbine State–of–the–Art Technology Seminar", Tab 24, "Mechanical Drive Steam Turbines", D. R.
"39th Turbine State–of–the–Art Technology Seminar", Tab 25, "Steam Turbines for STAG™ Combined–Cycle Power Systems", M. Bos, Aug. 1996.
"39th Turbine State–of–the–Art Technology Seminar", Tab 26, "Cogeneration Application Considerations", Fisk et al., Aug. 1996.
"39th Turbine State–of–the–Art Technology Seminar", Tab 27, "Performance and Economic Considerations of Repowering Steam Power Plants", Stoll et al., Aug. 1996.
"39th Turbine State–of–the–Art Technology Seminar", Tab 28, "High–Power–Density™ Steam Turbine Design Evolution", J. H. Moore, Aug. 1996.
"39th Turbine State–of–the–Art Technology Seminar", Tab 29, "Advances in Steam Path Technologies", Cofer, IV, et al., Aug. 1996.
"39th Turbine State–of–the–Art Technology Seminar", Tab 30, "Upgradable Opportunities for Steam Turbines", D. R. Dreier, Jr., Aug. 1996.
"39th Turbine State–of–the–Art Technology Seminar", Tab 31, "Uprate Options for Industrial Turbines", R. C. Beck, Aug. 1996.
"39th Turbine State–of–the–Art Technology Seminar", Tab 32, "Thermal Performance Evaluation and Assessment of Steam Turbine Units", P. Albert, Aug. 1996.
"39th Turbine State–of–the–Art Technology Seminar", Tab 33, "Advances in Welding Repair Technology" J. F. Nolan, Aug. 1996.
"39th Turbine State–of–the–Art Technology Seminar", Tab 34, "Operation and Maintenance Strategies to Enhance Plant Profitability", MacGillivray et al., Aug. 1996.
"39th Turbine State–of–the–Art Technology Seminar", Tab 35, "Generator InSitu Inspections", D. Stanton.
"39th Turbine State–of–the–Art Technology Seminar", Tab 36, "Generator Upgrade and Rewind", Halpern et al., Aug. 1996.
"39th Turbine State–of–the–Art Technology Seminar", Tab 37, "GE Combined Cycle Product Line and Performance", Chase et al., Aug. 1996.
"39th Turbine State–of–the–Art Technology Seminar", Tab 38, "GE Combined Cycle Experience", Maslak et al., Aug. 1996.
"39th Turbine State–of–the–Art Technology Seminar", Tab 39, "Single–Shaft Combined Cycle Power Generation Systems", Tomlinson et al., Aug. 1996.
"Advanced Turbine System Program –Conceptual Design and Product Development", Annual Report, Sep. 1, 1994 – Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown,WV.
"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems"Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Actitivities at the GE Power Systems Gas Turbine Manufacturing Facility, Greenville, SC", Document #1753, Feb. 1998, Publication Date: Nov. 17, 1998, Report Numbers DE–FC21–95MC31176—11.
"Exhibit panels used at 1995 product introduction at PowerGen Europe".
"Extensive Testing Program Validates high Effieciency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas System Work as Single Unit in GE's Advanced H Technology Combined–Cycle System" Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C. Publication Release.

"H Technology Commercialization", 1998 MarComm Activity Recommendation, Mar., 1998.

"H Technology", Jon Ebacher, VP Power Gen Technology, May. 8, 1998.

"H Testing Process", Jon Ebacher, VP, Power Gen Technology, May 8, 1998.

"Heavy–Duty & Aeroderivative Products"Gas Turbines, Brochure, 1998.

"MS7001H/MS9001H Gas Turbine, gepower.com websites for PowerGen Europe" Jun. 1–3 going public Jun. 15, (1995).

"New Steam Cooling System is Key 66% Efficiency For GE "H" Technology Combined –Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21st Century–"H"Gas Turbine Combined Cycles", Thomas C. Paul et al., Report,.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, p. 3–13, Oct. 1995.

"Proceedings of the Advanced Turbine Systems Annual Program Review Meeting", vol. I, "H Gas Turbine Combined Cycle", J. Corman, p. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct. 1995.

"Proceedings of the Advanced Turbine Systems Annual Program Review Meeting", vol. I, "Allison Engine ATS Program Technical Review", D. Mukavetz, p. 31–42, Oct. 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., p. 87–88, Oct. , 1995.

"Proceedings of the Advanced Turbine Systems Annual Program Review Meeting", vol. 1, "Advanced Turbine Systems Program Review", William E. Koop, pp. 89–92, Oct. 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "The Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Meuller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinghouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al,m pp. 200–220, Oct., 1995.

"Proceedings of the Advanced Turbine Systems Annual Program Review Meeting", vol. II, "Lean Premixed Combustion Stabilized by Radiation Feedback and heterogenous Catalysis", Dibble et al., pp. 221–232, Oct., 1995.

"Proceedings of the Advanced Turbine Systems Annual Program Review Meeting", vol. II, "Rayleigh/Raman/LIF Measurements in a Turbulent Lean Premixed Combustor", Nandula et al., pp. 233–248, Oct., 1995.

"Proceedings of the Advanced Turbine Systems Annual Program Review Meeting", vol. II, "Lean Premixed Flames for Low $No_x$Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280 Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting", vol. II, The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct. 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", vol. II, "ATS and the Industries of the Future", Denise Swink, p. 1, Nov., 1996.

"Proceedings of the Advanced Turbine Systems Annual Program Review Meeting", vol. II, "Gas Turbine Association Agenda", William H. Day, pp. 3–16, Nov., 1996.

"Proceedings of the Advanced Turbine Systems Annual Program Review Meeting", vol. II, "Power Needs in the Chemical Industry", Keith Davidson, pp. 17–26, Nov., 1996.

"Proceedings of the Advanced Turbine Systems Annual Program Review Meeting", vol. II, "Advanced Turbine Systems Program Overview", David Esbeck, pp. 27–34, Nov., 1996.

"Proceedings of the Advanced Turbine Systems Annual Program Review Meeting", vol. II, "Westinghouse's Advanced Turbine Systems Program", Gerard McQuiggan, pp. 35–48, Nov., 1996.

"Proceedings of the Advanced Turbine Systems Annual Program Review Meeting", vol. II, "Overview of GE's H Gas Turbine Combined Cycle", Cook et al., pp. 49–72, Nov., 1996.

"Proceedings of the Advanced Turbine Systems Annual Program Review Meeting", vol. II, "Allison Advanced Simple Cycle Gas Turbine System", William D. Weisbrod, pp. 73–94, Nov., 1996.

"Proceedings of the Advanced Turbine Systems Annual Program Review Meeting", vol. II, "The AGTSR Industry–University Consortium", Lawrence P. Golan, pp. 95–110, Nov., 1996.

"Proceedings of the Advanced Turbine Systems Annual Program Review Meeting", vol. II, "$NO_x$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", vol. II, "Methodologies for Active Mixing and Combustion Control", Uri Vandsburger, pp. 123–156, Nov., 1996.

"Proceedings of the Advanced Turbine Systems Annual Program Review Meeting", vol. II, "Combustion Modeling in Advanced Gas Turbine Systems", Paul O. Hedman, pp. 157–180, Nov., 19967.

"Proceedings of the Advanced Turbine Systems Annual Program Review Meeting", vol. II, "Manifold Methods for Methane Combustion", Stephen B. Pope, pp. 181–188, Nov., 1996.

"Proceedings of the Advanced Turbine Systems Annual Program Review Meeting", vol. II, "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Review Meeting", vol. II, "Effect of Swirl and Momentum Distribution on Temperature Distribution in Premixed Flames", Ashwani K. Gupta, p. 211–232, Nov., 1996.

"Proceedings of the Advanced Turbine Systems Annual Program Review Meeting", vol. II, "Combustion Instability Studies Application to Land–Based Gas Turbine Combustors", Robert J. Santoro, pp. 233–252.

"Proceedings of the Advanced Turbine Systems Annual Program Review Meeting", vol. II, "Active Control of Combustion Instabilities in Low $NO_x$ Turbines", Ben T. Zimm, pp. 253–264, Nov., 1996.

"Proceedings of the Advanced Turbine Systems Annual Program Review Meeting", vol. II, "Life Prediction of Advanced Materials for Gas Turbine Application," Sam Y. Zamrik, pp. 265–274, Nov., 1996.

"Proceedings of the Advanced Turbine Systems Annual Program Review Meeting", vol. II, "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", vol. II, "Compatibility of Gas Turbine Materials with Steam Cooling", Vimal Desai, pp. 291–314, Nov., 1996.

"Proceedings of the Advanced Turbine Systems Annual Program Review Meeting", vol. II, "Bond Strength and Stress Measurements in Thermal Barrier Coatings", Maurice Gell, pp. 315–334, Nov., 1996.

"Proceedings of the Advanced Turbine Systems Annual Program Review Meeting", vol. II, "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", vol. II, "Flow Characteristics of an Intercooler System for Power Generating Gas Turbines", Ajay K. Agarwal, pp. 357–370, Nov., 1996.

"Proceedings of the Advanced Turbine Systems Annual Program Review Meeting", vol. II, "Improved Modeling Techniques for Turbomachinery Flow Fields", B. Lakshiminarayana, pp. 371–392, Nov., 1996.

"Proceedings of the Advanced Turbine Systems Annual Program Review Meeting", vol. II, "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", vol. II, "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov. 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535–552 Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A, Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's ", Norman Bornstein, pp. 623–631, Nov., 1996.

"Proceedings of the Advanced Turbine Systems Annual Program Review Meeting", "Ceramic Stationary Gas Turbine", Matk van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine – High Efficiency, Low Cost of Electricity and Low Emissions", Roger Schonewald and Patrick Marolda, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1—Dec. 31, 1996, Publication Date, Jun. 1, 1997, Report Nos.: DOE/MC/31176—5628,.
"Utility Advanced Turbine System (ATS) Technology Readiness Testing—Phase 3", Document #666274, Oct. 1, 1996—Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176–5340.
"Testing Program Results Validate GE's H Gas Turbine—High Efficiency, Low Cost of Electricity and Low Emissions", Slide Presentation –working draft ( no date available).
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1—Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1—Jun. 30, 1997, Publication Date, Dec. 31, 1997, Report Nos.: DOE/MC/31176–8.
"Utility Advanced Turbine System (ATS) Technology Readiness Testing and Pre–Commercial Demonstration" Jan. 1—Mar. 31, 1996, DOE/MC/31176–5338.
"Utility Advanced Turbine System (ATS) Technology Readiness Testing: Phase 3R", Document #756552, Apr. 1—Jun. 30, 1999, Publication Date, Sep. 1, 1999, Report Nos.: DE–FC21–95MC31176–23.
"Utility Advanced Turbine System (ATS) Technology Readiness Testing.", Document #656823, Jan 1—Mar. 31, 1998, Publication Date, Aug. 1, 1998, Report Nos.: DOE/MC31176–17.
"Utility Advanced Turbine Systems (ATS) Technology Readiness Testing and Pre–Commercial Demonstration", Annual Technical Progress Report, Reporting Period: Jul. 1, 1995—Sep. 30, 1996.
"Utility Advanced Turbine Systems (ATS) Technology Readiness Testing", Phase 3R, Annual Technical Progress Report, Reporting Period: Oct. 1, 1997—Sep. 30, 1998.
"Utility Advanced Turbine Systems (ATS) Technology Readiness Testing", Document #750405, Oct. 1—Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1—Jun. 29, 1998, Publication Date Oct. 29, 1998, Report Nos. DE–FC21–95MC31776–18.
"Utility Advanced Turbine Systems (ATS) Technology Readiness Testing—Phase 3", Annual Technical Progress Report, Reporting Period: Oct. 1, 1996—Sep. 30, 1997.
"Utility Advanced Turbine Systems (ATS) Technology Readiness Testing and Pre–Commercial Demonstration", Quarterly Report, Jan. 1—Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

WHEELSPACE WINDAGE COVER PLATE FOR TURBINE

CROSS REFERENCE TO RELATED APPLICATIONS

This application is a continuation of application Ser. No. 09/226,462, filed Jan. 6, 1999, the disclosure of which is incorporated herein by reference, now abandoned.

This invention was made with Government support under Contract No. DE- FC21-95MC31176 awarded by the Department of Energy. The Government has certain rights in this invention.

BACKGROUND OF THE INVENTION

The present invention relates to a wheelspace windage cover plate for spanning between a turbine wheel bucket dovetail and an adjoining spacer in a turbine rotor and particularly relates to a windage cover plate for substantially precluding hot flow path gas ingestion into the turbine wheelspace cavity.

Wheelspace cover plates have been proposed and constructed in the past. Typically, those cover plates extend between the turbine wheel and adjoining spacer. The cover plates, however, are not typically readily removable for access into interior portions of the rotor. The attachment directly to the turbine wheel also causes maintenance problems and the joints between the adjacent cover plates have not been found particularly effective to minimize leakage of the hot gas into the wheelspace.

Wheelspace cover plates in general, however, preclude ingestion of hot gas from the hot gas flow path into the turbine wheelspace cavity which would otherwise cause damage to the turbine wheel. Removability of the cover plates for access to the wheelspace cavity becomes an issue in advanced turbine design because the wheelspace cavities house a multiplicity of tubing for conducting a cooling circuit, for example, employing steam as the cooling medium, for internal cooling of the buckets. Conventional wheelspace covers attached between the spacer and wheel are not readily removed without disassembly of the rotor. Consequently, access to the various tubings and joints which supply the cooling medium to the buckets for maintenance or repair is quite difficult. In a more general sense, the cover plates must also withstand high operating temperatures, severe accelerations, must have high cycle fatigue endurance and afford minimal hot gas leakage into the turbine wheelspace cavity.

BRIEF SUMMARY OF THE INVENTION

In accordance with the present invention, there is provided a wheelspace windage cover for precluding hot flow path gas ingestion into the wheelspace cavity between the turbine wheel and spacer and which cover can be readily installed and removed for access to interior portions of the rotor. Particularly, the wheelspace cover comprises a plurality of cover plates arranged in a circumferential array between the spacer and a turbine wheel. Each cover plate has an engagement structure along an axial edge for engaging a complementary engagement structure on the spacer, i.e., the cover plate carries an arcuate projecting flange for engagement in a circumferential slot or groove on the axial face of the spacer. The opposite axial edge of the cover plate includes a radially extending wall having a recess for receiving a lug projecting axially from a bucket dovetail. A cover plate is provided at each bucket dovetail location.

With the cover plate tongue engaged in the groove of the spacer and the cover plate in position, the bucket dovetail is received in the female dovetail on the turbine wheel. When the bucket dovetail is finally secured to the turbine wheel, the bucket dovetail lug projects into the recess on the cover plate, maintaining the cover plate in position.

Lap joints are formed between the end edges of adjacent cover plates. The tongues on the end edges of the cover plates alternate from cover plate to cover plate. That is, the circumferentially projecting tongues of one cover plate underlie oppositely directed circumferentially projecting tongues of the end edges of adjacent cover plates. With this arrangement of lap joints, access to the wheelspace cavity at any location about the rotor is available by removing one, or at the most, two, adjacent cover plates by first removing the associated bucket from its dovetail connection with the turbine wheel. Thus, by withdrawing the bucket dovetail lug from its associated cover plate, the cover plate may be removed, assuming the tongues at the end of the cover plate overlap the tongues of adjoining cover plates. If access to an adjacent location is required, the second cover plate adjacent the first cover plate may likewise be removed.

With this arrangement of cover plates and lap joints between circumferentially adjacent cover plates, gas leakage into the turbine wheelspace cavity is minimized. Additionally, the windage within the rotor is substantially reduced.

In a preferred embodiment according to the present invention, there is provided a cover plate for disposition in the space between a turbine rotor wheel and a spacer rotatable about an axis wherein the wheel has circumferentially spaced buckets, including bucket dovetails with dovetail lugs extending axially in one direction and the spacer includes a circumferentially extending groove in general spaced registration with the lugs, comprising a cover plate body having along one side an axially extending tongue for engaging in the groove of the spacer and a recess along an axially opposite side for receiving one of the axially extending lugs of the bucket dovetail and a flange projecting from each of the opposite ends of the cover plate body for engaging an adjoining cover plate about the turbine rotor.

In a further preferred embodiment according to the present invention, there is provided in a turbine rotor having a turbine rotor wheel and a spacer rotatable about an axis, the wheel having circumferentially spaced buckets, including bucket dovetails with dovetail lugs extending axially in one direction, the spacer including a circumferentially extending groove in general spaced registration with the lugs, a cover plate for disposition in the space between the wheel and the spacer and including a cover plate body having along one side an axially extending tongue engaged in the groove of the spacer and a recess along an axially opposite side for receiving one of the axially extending lugs of the bucket dovetails, the cover plate further including a flange projecting from each of the opposite ends of the cover plate body for engaging an adjoining cover plate about the turbine rotor.

In a still further preferred embodiment according to the present invention, there is provided a cover for enclosing the space between a turbine rotor wheel and a spacer rotatable about an axis wherein the wheel has circumferentially spaced buckets, including bucket dovetails with dovetail lugs extending axially in one direction and the spacer has cover engagement structure, comprising a plurality of cover plates each including a cover plate body having along a first axially facing side thereof spacer engagement structure complementary to the cover engagement structure carried by the spacer and a recess along a second axially facing side thereof for receiving one of the axially extending lugs and overlapping complementary engagement elements on registering ends of the circumferentially adjacent cover plates for minimizing fluid leakage past the cover.

Accordingly, it is a primary object of the present invention to provide a novel and improved cover for overlying the wheelspace cavity between a spacer and turbine wheel which minimizes hot gas leakage into the wheelspace cavity, while affording ease of maintenance by facilitating removal of one or more of the cover plates for access to the wheelspace cavity.

DETAILED DESCRIPTION OF THE INVENTION

Figure 1:
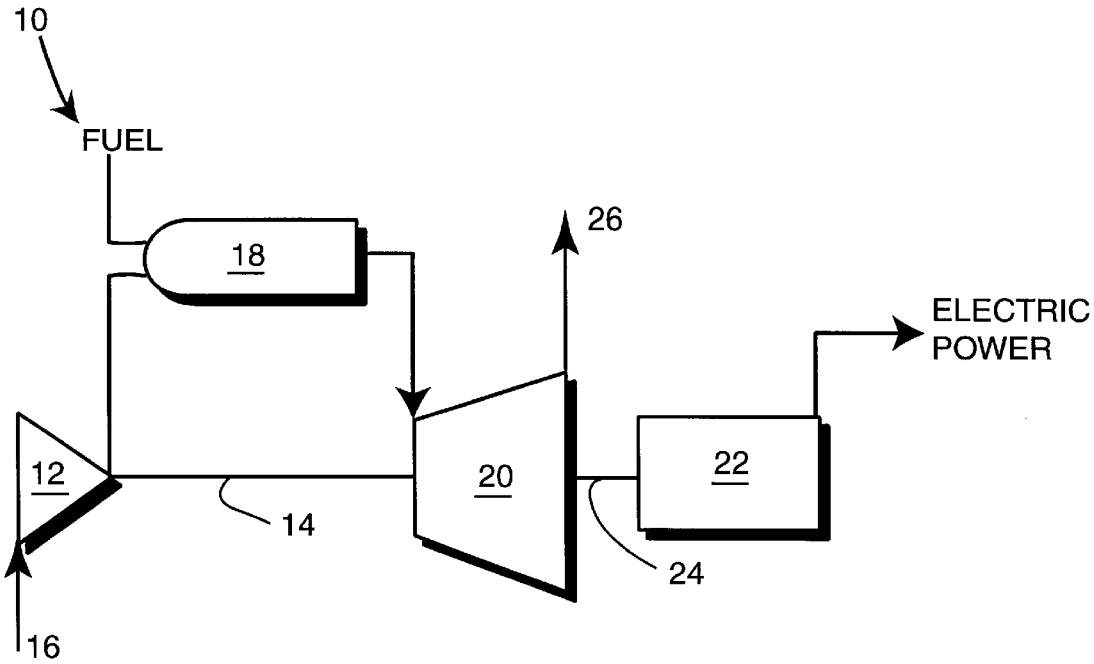
FIG. 1 is a schematic illustration of a power generation system incorporating a gas turbine with wheelspace windage cover plates according to the present invention.

FIG. 1 is a schematic diagram of a simple cycle, single-shaft heavy-duty gas turbine 10 incorporating the present invention. The gas turbine may be considered as comprising a multi-stage axial flow compressor 12 having a rotor shaft 14. Air enters the inlet of the compressor at 16, is compressed by the axial flow compressor 12 and then is discharged to a combustor 18 where fuel such as natural gas is burned to provide high-energy combustion gases which drive the turbine 20. In the turbine 20, the energy of the hot gases is converted into work, some of which is used to drive the compressor 12 through shaft 14, with the remainder being available for useful work to drive a load such as a generator 22 by means of rotor shaft 24 for producing electricity. A typical simple cycle gas turbine will convert 30 to 35% of the fuel input into shaft output. All but 1 to 2% of the remainder is in the form of exhaust heat which exits turbine 20 at 26. Higher efficiencies can be obtained by utilizing the gas turbine 10 in a combined cycle configuration in which the energy in the turbine exhaust stream is converted into additional useful work.

Figure 2:
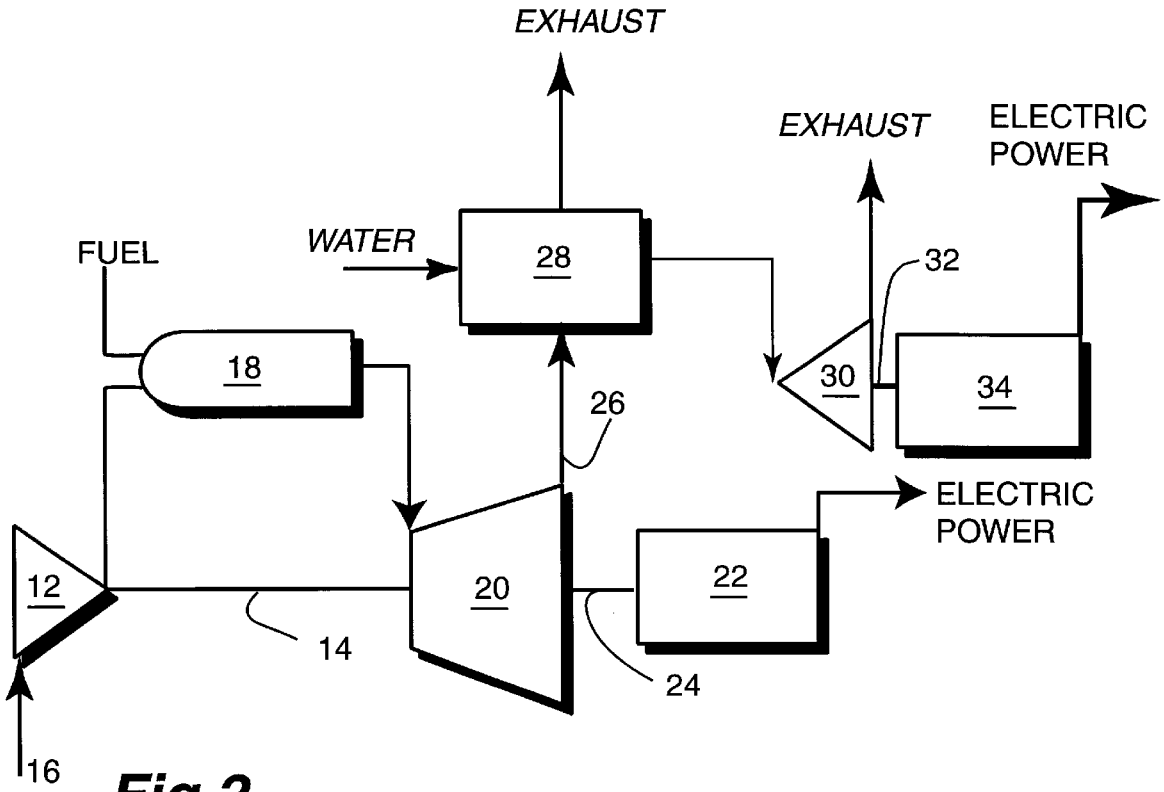
FIG. 2 is a schematic diagram of a combined cycle system in which the present invention is incorporated.

FIG. 2 represents a combined cycle in its simplest form, in which the exhaust gases exiting turbine 20 at 26 enter a heat recovery steam generator 28 in which water is converted to steam in the manner of a boiler. Steam thus produced drives one or more steam turbines 30 in which additional work is extracted to drive through shaft 32 an additional load such as a second generator 34 which, in turn, produces additional electric power. In some configurations, turbines 20 and 30 drive a common generator. Combined cycles producing only electrical power are generally in the 50 to 60% thermal efficiency range and using a more advanced gas turbine, of which the present tube assembly forms a part, permits efficiencies in excess of 60%.

Figure 3:
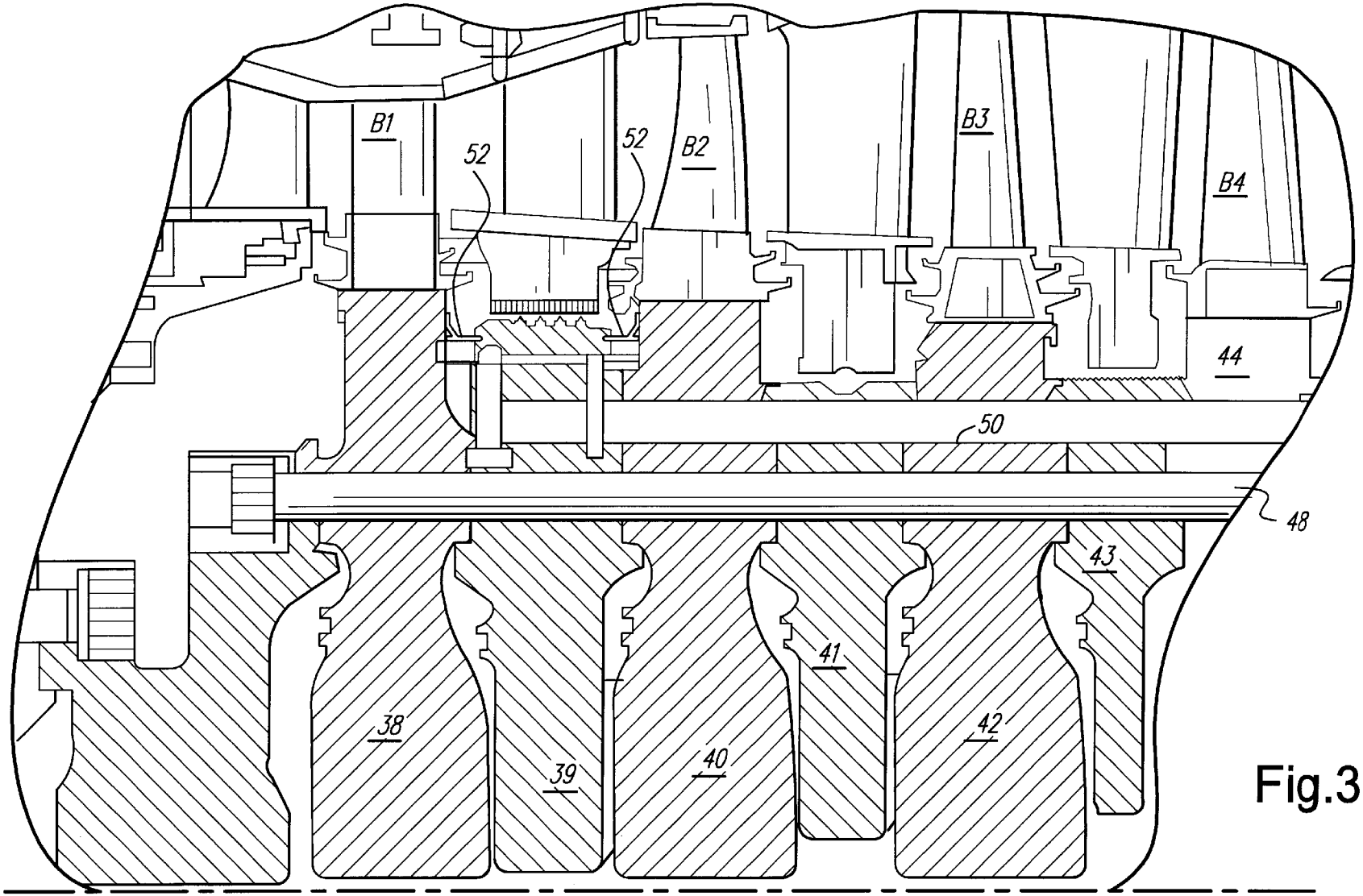
FIG. 3 is an enlarged fragmentary longitudinal cross-sectional view of a gas turbine illustrating the location of the wheelspace windage cover plates of the present invention.

Referring now to FIG. 3, a section of the turbine 20 is in part illustrated. The turbine section includes four successive stages comprising turbine wheels 38, 40, 42 and 44 mounted to and forming part of the rotor shaft for rotation therewith, each carrying a row of buckets B1, B2, B3 and B4 and which buckets project radially outwardly of the rotor wheels. The buckets are, of course, arranged alternately between fixed nozzles, also not shown. Between the wheels 38, 40, 42 and 44 there are provided spacers 39, 41 and 43. It will be appreciated that the wheels and spacers are secured to one another by a plurality of circumferentially spaced, axially extending bolts 48, as is conventional in turbine construction. While not disclosed in any detail in the present application, the illustrated gas turbine is steam-cooled and cooling steam, as well as spent return steam, is supplied and exhausted via axially extending passages, one of which is shown at 50 and which passages lie in axially registering openings through the wheels and spacers at circumferentially spaced positions about the rotor. Additional crossover tubes forming part of the steam-cooling system are provided in the spacer 39 adjacent the spacer rim.

Wheelspace cover plates 52, in accordance with the present invention, are located between wheel 38 and spacer 39 and wheel 40 and spacer 39. At each location, the cover plates 52 lie circumferentially adjacent one another about the turbine rotor and prevent the hot gases of combustion flowing past the buckets and nozzles from flowing into the wheelspace cavity radially inwardly of the cover plates and between the wheels and spacer. While the wheelspace cover plates are disposed between the first and second stage rotor wheels and the spacer therebetween, it will be appreciated that the cover plates may be employed at other stages.

Figure 6:
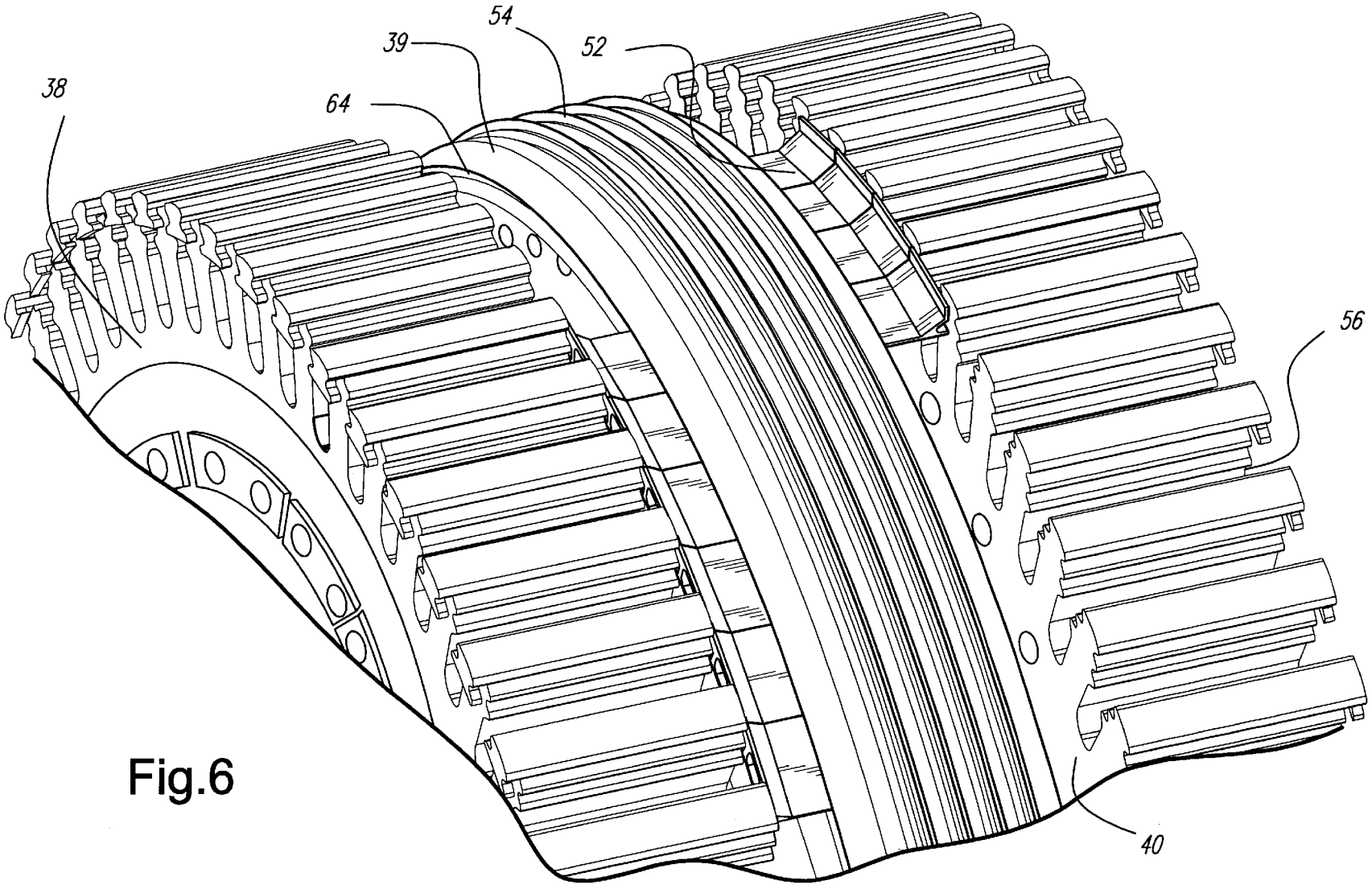
FIG. 6 is a fragmentary perspective view of the windage cover plates hereof in position between the first and second stage turbine wheels.
Figure 7:
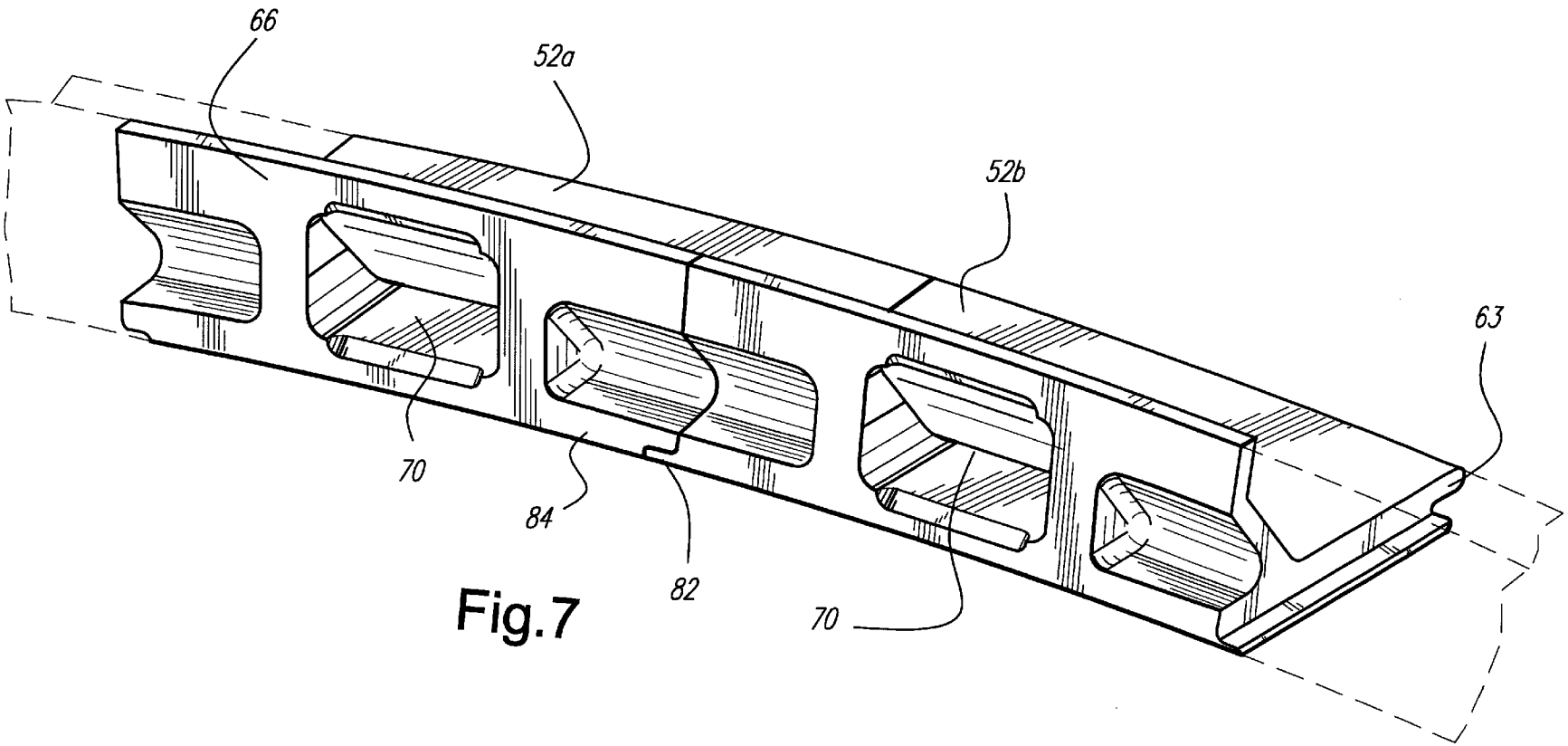
FIG. 7 is a fragmentary perspective view of a pair of adjacent windage cover plates.

Referring to FIG. 6, the first and second stage wheels 38 and 40, as well as the spacer 39 between the wheels are illustrated. Also illustrated are labyrinth seal teeth 54 disposed about the rim of the spacer 39 for forming a seal with the radially outward nozzle stage. Also illustrated in FIG. 6 are a plurality of circumferentially spaced, axially extending dovetails 56 for each of the wheels 38 and 40. The dovetails 56 receive complementary-shaped dovetails 45 of the buckets B1 and B2 by which dovetails 45 of the buckets are secured to the wheels. Each of the bucket dovetails 45 are attached to the wheels by axially sliding the bucket dovetails in the dovetails 56 of the wheels. The ends of the bucket dovetails 45 facing the spacer 39 have a projecting lug 47 (FIG. 8) which is complementary in shape to a lug opening in the wheelspace covers hereof. As illustrated, a wheelspace cover plate according to one embodiment of the present invention is provided for each wheel dovetail slot 56 with the bucket dovetail lug 47 assisting to maintain the cover plate situate between the wheel and the adjoining spacer.

Figure 4:
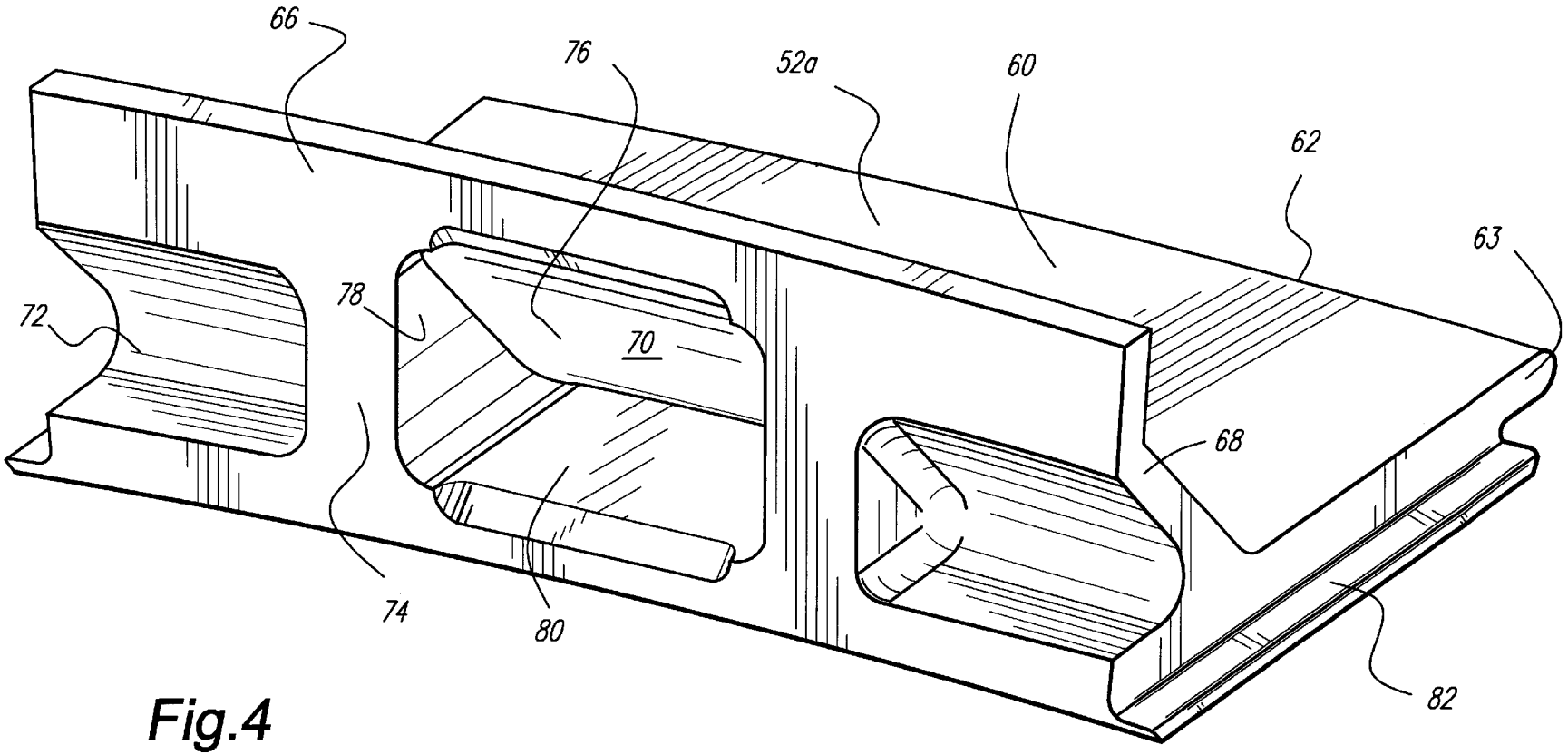
FIGS. 4 and 5 are perspective views of windage cover plates according to the present invention and which plates are employed circumferentially adjacent one another.
Figure 5:
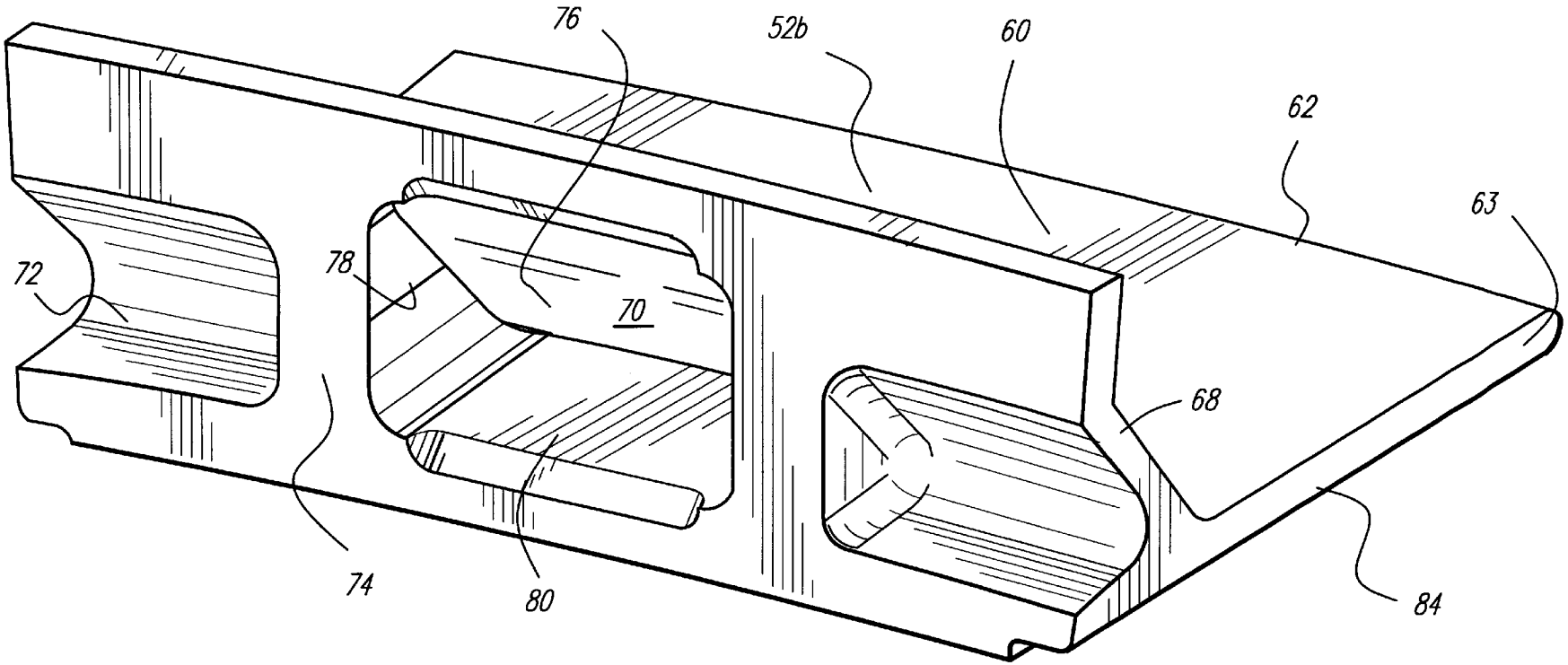

Referring now to FIGS. 4 and 5, the cover plates 52 at each circumferential position about the rotor are identical to one another except for the projecting circumferentially extending end flanges as described below. Thus, referring to the cover plate 52*a* illustrated in FIG. 4, there is illustrated a cover plate body 60 which is linearly extending in an axial direction but which is arcuate in a circumferential direction. One axially extending edge 62 of cover plate 52*a* has a radially outwardly axially projecting tongue 63 which is received in a circumferentially extending groove 64 on the spacer (FIGS. 3 and 6). At the opposite axial end of the wheel cover plate, there is a radially extending flange 66 projecting radially outwardly of the body 60. The flange 66 also includes an angled wall 68 whereby a central recess 70, as well as end recesses 72, are formed opening through the axial face of wall 66. Radially outwardly extending gussets 74 extend between the central recess or opening 70 and the end recesses 72.

Figure 8:
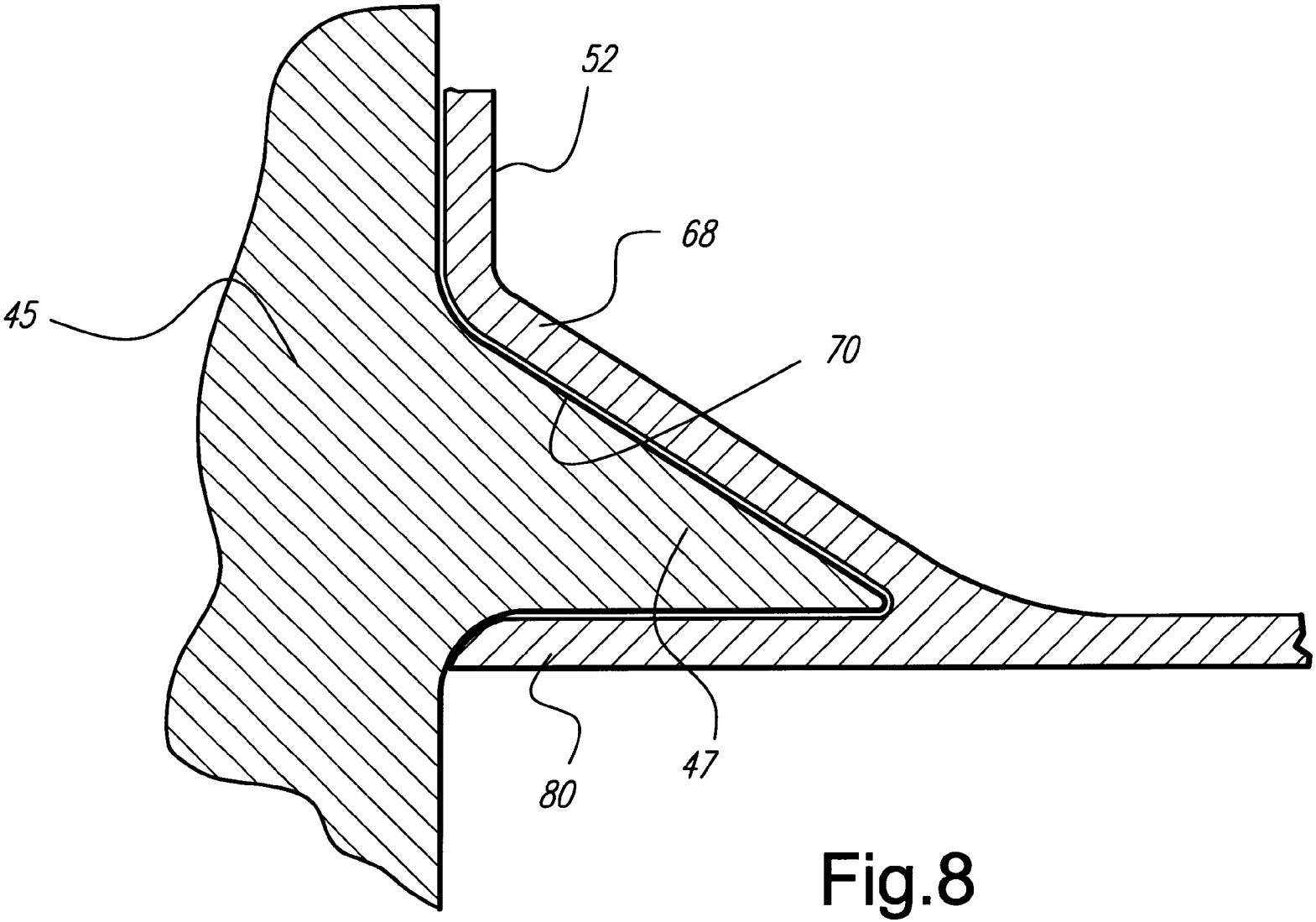
FIG. 8 is a cross-sectional view illustrating the bucket dovetail lug inserted into the recess of the cover plate.

As illustrated in FIG. 8, the central recess or opening 70 is generally complementary in shape to the lug 47 formed on each of the bucket dovetails 45. The opening 70 thus includes an angled wall 68, side walls 78 and a bottom wall 80, the inclined wall 68 and bottom wall 80 forming an apex 81 in opening 70. The bottom wall 80 extends in a generally axial direction, while the angled wall 68 angles radially outwardly and axially. It will be appreciated that when the lug 47 of the bucket dovetail 45 engages within the opening 70, the cover plate 52 is confined between the wheel and the spacer by the tongue 63 engaging in the spacer groove 64 at one axial end, while at the opposite axial end, the bottom face of the dovetail lug precludes radial outward movement of the cover plate. Additionally, of course, the complementary shaped side and upper faces of the opening and dovetail, respectively, preclude circumferential movement, as well as radial inward movement of that axial end of the cover plate.

In accordance with an embodiment of the present invention, lap joints are formed between circumferentially adjacent cover plates. Each cover plate has identical flanges extending in a circumferential direction from its opposite ends, the flanges 82 for cover plate 52*a* illustrated in FIG. 4 lying radially inwardly of the flanges 84 of the cover plate 52*b* illustrated in FIG. 5. Note that the end flanges 82 of the cover plate 52*a* illustrated in FIG. 4 are at identical radial inward positions and that the end flanges 84 of the cover plate 52*b* of FIG. 5 are at identical radially outer positions. Upon assembly of the cover plates between the wheels and spacers, it will be appreciated that the cover plates 52*a* and 52*b* alternate about the circumference of the rotor. This is significant from the standpoint of access to the wheel cavity space radially inwardly of the cover plates as described below. It will also be appreciated that the recesses 70 and 72 have fillets at the junctures between the side, inclined and bottom walls. The fillets serve to provide stress-relief.

To install the cover plates, the tongue 62 of a first cover plate is inserted into the groove 64 of the spacer 39. The recess 70 at the opposite axial end of the cover plate is aligned with the dovetail slot 56 of the wheel. Upon axial entry of the bucket dovetail 45 in that slot 56, the dovetail lug 47 engages in the recess 70. Upon securement of the bucket to the wheel in a conventional manner, it will be appreciated that the cover plate is captured axially between the wheel and spacer by the tongue and dovetail lug engagement with the spacer and cover plate, respectively. Also, the cover plate is prevented from circumferential movement by the dovetail lug engaging in opening 70. The next cover plate 52*b* is then similarly installed by engaging the tongue 60*b* into the slot 39 of the spacer and aligning the opening 70 with the next dovetail slot 56. It will be appreciated that the cover plate 52*b* is selected such that upon installation, the circumferential extending flange 84 of the cover plate 52*b* radially overlaps the circumferentially extending flange 82 of the installed cover plate. By engaging the bucket dovetail in the dovetail slot 56 and the dovetail lug 47 in the opening 70 of the cover plate 52*b*, the second cover plate is installed in the rotor. The next cover plate 52*a* is then installed in a similar manner, with its radially inwardly circumferentially extending flange 82 engaging radially inwardly of the radially overlying flange 84 of the cover plate 52*b*. Additional cover plates are installed in this manner until the last opening for the cover plate is reached. By inserting the tongue of this last cover plate into the spacer groove 39, and aligning the opening 70 with the last-to-be-installed dovetail slot 56, the final cover plate is installed. Note that the circumferential end flanges 84 of the final cover plate 52*b* are radially outwardly of the radially inwardly circumferentially extending flanges 82 of adjacent cover plates 52*a* such that the end flanges 84 of the final cover plate overlie the end flanges 82 of the adjacent plates.

It will be appreciated that upon installation of the cover plates, that the wheelspace cavity between the wheels and spacer is completely covered in a circumferential direction. To gain access to the wheelspace cavity, for example, to the crossover tubes forming part of the steam-cooling circuit for the gas turbine, it is only necessary to remove the cover plate or the two or three of the adjacent cover plates overlying the area of interest. To accomplish this, the axially aligned bucket registering with the nearest cover plate 52*b* overlying the area of interest is removed by releasing the bucket dovetail 45 and axially sliding the bucket away from the cover plate 52*b*. When the dovetail lug 47 is withdrawn from the opening 70, the cover plate 52*b* can be removed. Additional cover plates adjacent the removed cover plate can likewise be similarly removed. In this manner, access to the wheelspace cavity at the circumferential area of interest is obtained without removal of all of the cover plates circumferentially about the rotor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cover plate for disposition in the space between a turbine rotor wheel and a spacer rotatable about an axis wherein the wheel has circumferentially spaced buckets, including bucket dovetails with dovetail lugs extending axially in one direction and the spacer includes a circumferentially extending groove in general spaced registration with said lugs, comprising:

a cover plate body having along one side an axially extending tongue for engaging in the groove of the spacer and a recess along an axially opposite side for receiving one of the axially extending lugs of the bucket dovetail; and a flange projecting from each of the opposite ends of said cover plate body for engaging an adjoining cover plate about the turbine rotor.

2. A cover plate according to claim 1 wherein said cover plate body has an upstanding flange along said axially opposite side, said recess at least in part being disposed in said flange and opening toward said opposite axial side.

3. A cover plate according to claim 1 wherein said cover plate body is arcuate about said axis.

4. A cover according to claim 1 wherein said cover plate body has an upstanding flange along said axially opposite side, said recess at least in part being disposed in said flange and opening toward said opposite axial side, said recess being defined in part by an inclined wall and a generally axially extending wall forming an apex.

5. In a turbine rotor having a turbine rotor wheel and a spacer rotatable about an axis, said wheel having circumferentially spaced buckets, including bucket dovetails with dovetail lugs extending axially in one direction, said spacer including a circumferentially extending groove in general spaced registration with said lugs, a cover plate for disposition in the space between said wheel and said spacer and including a cover plate body having along one side an axially extending tongue engaged in the groove of said spacer and a recess along an axially opposite side for receiving one of said axially extending lugs of said bucket dovetails, said cover plate further including a flange projecting from each of the opposite ends of said cover plate body for engaging an adjoining cover plate about the turbine rotor.

6. A turbine rotor and cover plate combination according to claim 5 wherein said cover plate body has an upstanding flange along said axially opposite side, said recess at least in part being disposed in said flange and opening toward said opposite axial side.

7. A turbine rotor and cover plate combination according to claim 5 wherein said cover plate body is arcuate about said axis.

8. A cover according to claim 5 wherein said cover plate body has an upstanding flange along said axially opposite side, said recess at least in part being disposed in said flange and opening toward said opposite axial side, said recess being defined in part by an inclined wall and a generally axially extending wall forming an apex.

9. A cover for enclosing the space between a turbine rotor wheel and a spacer rotatable about an axis wherein the wheel has circumferentially spaced buckets, including bucket dovetails with dovetail lugs extending axially in one direction and the spacer has cover engagement structure, comprising:

a plurality of cover plates each including a cover plate body having along a first axially facing side thereof spacer engagement structure complementary to the cover engagement structure carried by the spacer and a recess along a second axially facing side thereof for receiving one of the axially extending lugs; and overlapping complementary engagement elements on registering ends of the circumferentially adjacent cover plates for minimizing fluid leakage past the cover.

10. A cover according to claim 9 wherein said engagement elements comprise lap joints.

11. A cover according to claim 10 wherein each said lap joint comprises a first flange projecting generally in a tangential direction from each cover plate and a second flange projecting generally in a tangential direction from an adjacent cover plate overlapping the first flange projection.

12. A cover according to claim 9 wherein each cover plate has flanges projecting from opposite ends thereof at identical radial locations about the rotor wheel spacer, circumferentially adjacent cover plates having said flanges at different radial locations about the rotor wheel and spacer and forming lapped joints with the flanges of one cover plate lying radially inwardly of the flanges of circumferentially adjacent cover plates.

* * * * *